US009138073B2

(12) United States Patent
Margolius

(10) Patent No.: US 9,138,073 B2
(45) Date of Patent: Sep. 22, 2015

(54) PORTABLE SEAT RESTRAINT APPARATUS AND METHOD OF USE

(71) Applicant: Farva Enterprises LLC, Key West, FL (US)

(72) Inventor: Michael Margolius, Key West, FL (US)

(73) Assignee: Farva Enterprises LLC, Key West, FL (US)

( * ) Notice: Subject to any disclaimer, the term of this patent is extended or adjusted under 35 U.S.C. 154(b) by 0 days.

(21) Appl. No.: 14/089,600

(22) Filed: Nov. 25, 2013

(65) Prior Publication Data

US 2014/0361596 A1 Dec. 11, 2014

(51) Int. Cl.
*A47D 15/00* (2006.01)

(52) U.S. Cl.
CPC ..... *A47D 15/006* (2013.01)

(58) Field of Classification Search
CPC ..... A47D 15/006
USPC ..... 297/467, 485
See application file for complete search history.

(56) References Cited

U.S. PATENT DOCUMENTS

| | | | | | |
|---|---|---|---|---|---|
| 1,310,958 | A | * | 7/1919 | O'Conner | 297/484 |
| 1,332,328 | A | * | 3/1920 | Fisher | 297/484 |
| 2,170,703 | A | * | 8/1939 | Waxman et al. | 297/485 |
| 2,225,018 | A | * | 12/1940 | Reason | 297/465 |
| 2,448,076 | A | * | 8/1948 | Bradley | 297/485 |
| 5,136,759 | A | * | 8/1992 | Armour, II | 24/442 |
| 5,203,613 | A | * | 4/1993 | Ward | 297/485 |
| 5,540,239 | A | * | 7/1996 | McClellan | 128/869 |
| 5,664,844 | A | * | 9/1997 | Greene | 297/485 |
| 5,676,426 | A | * | 10/1997 | Herring | 297/484 |
| 5,839,965 | A | * | 11/1998 | Mullins | 297/485 |

* cited by examiner

*Primary Examiner* — Peter Brown
(74) *Attorney, Agent, or Firm* — Zeller IP Group PLLC; Kyle M. Zeller

(57) ABSTRACT

A removable seat restraint apparatus intended to restrain a child on a variety of seats is provided. The apparatus may include an adjustable waist strap that fits snugly around the waist of the child and at least two connecting straps that are transversely attached at opposing end of the waist strap. The connecting straps may connect on the periphery of the seat to a support strap assembly which may be attached to one or more support structures such as a chair leg or pedestal. The length of the support straps may be adjustable to keep the waist centered on the seat when secured around the waist of the child.

7 Claims, 6 Drawing Sheets

PORTABLE SEAT RESTRAINT APPARATUS AND METHOD OF USE

FIELD OF THE INVENTION

The invention is applicable to the field of seat restraints and more specifically to removable and/or portable child restraint apparatuses adapted for use with highchairs or the like.

BACKGROUND

When traveling with a child, there are a variety of situations where the child will be in a seated position, for example in a restaurant or in a shopping cart. It may be desirable to restrain the child in such a seated position for safety reasons (i.e., to prohibit the child from falling out of the seat). Accordingly, may be necessary to provide a restraining apparatus on various forms of seats when a child is sitting in them.

As shown in FIG. 1, a typical restaurant highchair 102 may include some type of permanently attached restraining harness 104 and/or a rail 106 that extends over the legs of a child to keep the child from falling out. However, a rail 106 does not always prohibit the child from getting out of the seated position. For example, a small child may slip through a space between the seat 108 of a highchair and the rail 106. As another example, a larger child may stand up and exit the highchair over the rail 106.

Restraining harnesses 104 for children are typically permanently attached to the highchair, and/or specifically designed for a particular usage or type of seat. Even if a highchair includes a restraint, the restraint is frequently broken. For example, restraints may have broken bayonet clips or nylon webbing may be damaged from repeated use. This presents an unsafe situation for a child. Repair kits exist for highchairs, but they require tools to replace the straps, making it time consuming and impractical for consumers to safely secure their child.

Restraining harnesses that are permanently attached to a seat and used frequently by the public are subject to a lot of abuse as parents may be ambivalent to proper usage and care of the harness. Typical high chairs in public spaces may be stored haphazardly and knocked one against another creating an ideal situation where breakage of plastic connectors can occur. Improper cleaning may create a situation where buckling or clips may not operate correctly and/or may be unsanitary.

There is therefore a need for a portable and/or removable child seat restraint that is adjustable to fit a variety of seat types and a variety of individual children. It would be desirable if such an apparatus was lightweight and easily stored with existing equipment used in support of a child, such as but not limited to a diaper bag.

SUMMARY OF THE INVENTION

A portable seat restraint is described herein that can be employed to restrain a child in a variety of seating arrangements. The restraint may be lightweight, yet strong enough to prohibit a child restrained in a seat from exiting the seat either on purpose (e.g., wiggling or fidgeting) or inadvertently (e.g., falling or sliding out of the seat). The restraint may comprise various sizes to conform to a size of an individual using the apparatus and/or a particular type of seat on which the restraint may be used.

In various embodiment, exemplary portable restraint apparatuses may be sized to restrain a child for example within a highchair, a shopping cart, on a stool, and/or in a chair designed for either an adult or a child. The portable restraint apparatus described herein may be easily storable in a container such as a diaper bag, gym bag, briefcase, or the like. The apparatus may also be configured to be secured on one or more chair legs, on the underside of a seat, and/or a seat back. Exemplary apparatuses may be configured to be secured to a single pedestal support of a seat such as a stool. It will be appreciated that an exemplary apparatus may be adjustable to fit any sized child and/or a variety of seats.

In accordance with a preferred embodiment of the invention, there is disclosed a removable seat restraint apparatus comprising: a waist strap configured to loop around the waist of an intended user of the seat restraint when seated on a seat base, the waist strap being of adjustable length and with a method to clip around the waist of a user; a support strap assembly which attaches to various support structures of the seat, such as one or more chair legs; and one or more connecting straps which connect the waist strap to the support strap assembly. In various embodiments, the waist strap, connecting strap/s, and portions of the support strap assembly are movable or rigidly connected and straps may or may not have length adjustments or a clipping mechanism.

In one aspect of the invention, a removable seat restraint apparatus for use with a seat having a seat base connected to a support structure is provided. The removable seat restraint apparatus includes a waist strap configured to loop around the waist of an intended user of the seat restraint when seated on the seat base, the waist strap including a first end capable of being removably connected to a second end and at least one strap length adjustment. The apparatus also includes a support strap assembly with at least one support strap configured to fixedly loop around the support structure of the seat, the at least one support strap having a first end capable of being removably connected to a second end. A front connecting strap is also included and has a first end transversely attached to the waist strap and a second end transversely attached to the support strap assembly. The apparatus includes a back connecting strap comprising a first end transversely attached to the waist strap and a second end transversely attached to the support strap assembly. In certain embodiments, the first end of the front connecting strap may be located at an opposing location along the circumference of the waist strap from the first end of the back connecting strap, when in use, and second end of the front connecting strap may be located at an opposing side of the seat from the second end of the back connecting strap. Also, the at least one support strap may have a length configured to keep the waist strap on top of a base of the seat when in use.

In another aspect of the invention, a method of securing a child in a highchair having a seat, two front legs, and two back legs is provided. The method includes: securing a front support assembly to the highchair, wherein the front support assembly may include two front support straps connected to a front linking strap, and a front connecting strap attached to the front linking strap, and wherein securing the front support assembly to the highchair may include securing the front support straps to the two front legs of the highchair. The method may also include: securing a back support assembly to the highchair, wherein the back support assembly includes two back support straps connected to a back linking strap, and a back connecting strap attached to the back linking strap, and wherein securing the back support assembly to the highchair can include securing the back support straps to the two back legs of the highchair. Finally, the method may include securing the waist strap around a waist of the child, wherein the front connecting strap and back connecting strap are connected to the waist strap.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

Preferred embodiments of the present invention are illustrated by way of example and not limited to the following figures. It is to be understood that in some instances various aspects of the invention may be shown exaggerated or enlarged to facilitate an understanding of the invention.

DETAILED DESCRIPTION

Various embodiments and aspects of the invention will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present invention.

As used herein, the term "child" refers to a person needing restraint and capable of holding his torso upright without assistance.

As used herein, the term "support structure" defines one or more attachment points located on a seat to which a portable seat restraint apparatus may be attached. For example, a support structure may comprise one or more chair legs, a single pedestal of a bar stool, and/or an underside of a seat base.

As used herein, the term "strap" refers to a flexible, elongated structure such as webbing made of nylon, cotton or other woven material and also braided or twisted material such a rope.

Exemplary portable seat restraint apparatuses may be employed with any type seat, such as but not limited to a highchair, a seat in a shopping cart, a seat or bar stool designed for an adult, etc. The only requirement is that a seat comprise one or more support structures positioned in such a way that a connecting strap of a portable seat restraint apparatus may be tensioned (e.g., length adjusted) to keep the child in place on the seat when the child moves about when wearing a waist belt of a restraint.

Figure 1:
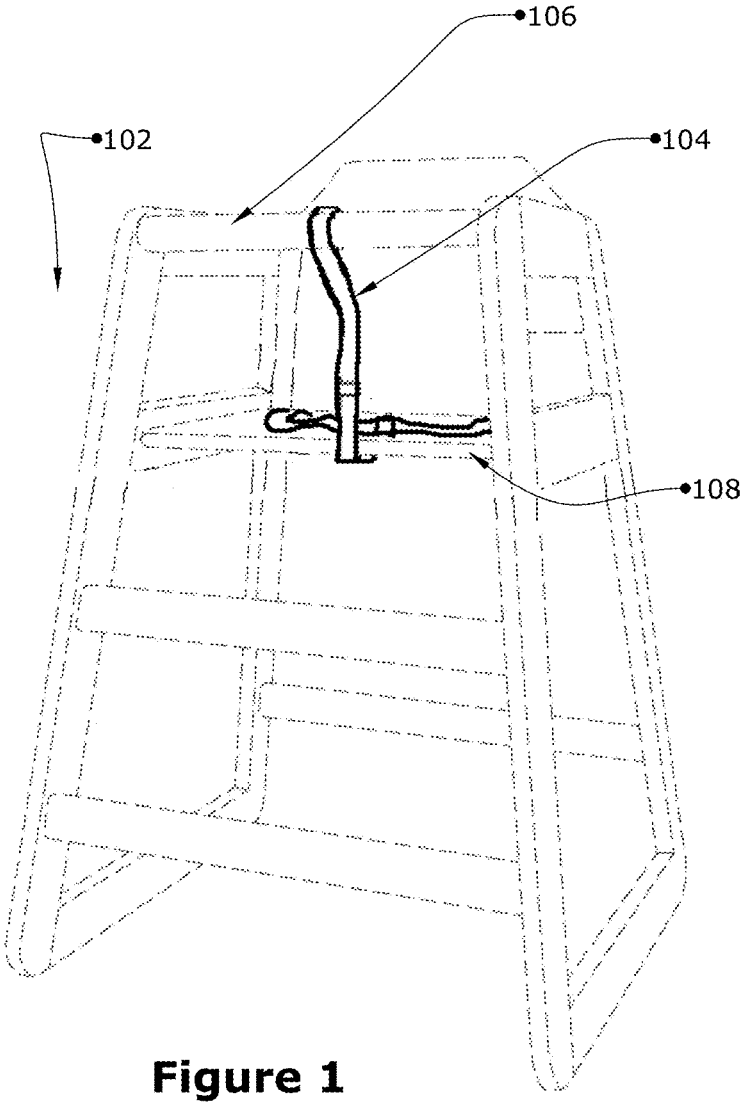
FIG. 1 illustrates a typical highchair with prior art permanent safety restraint.
Figure 2:
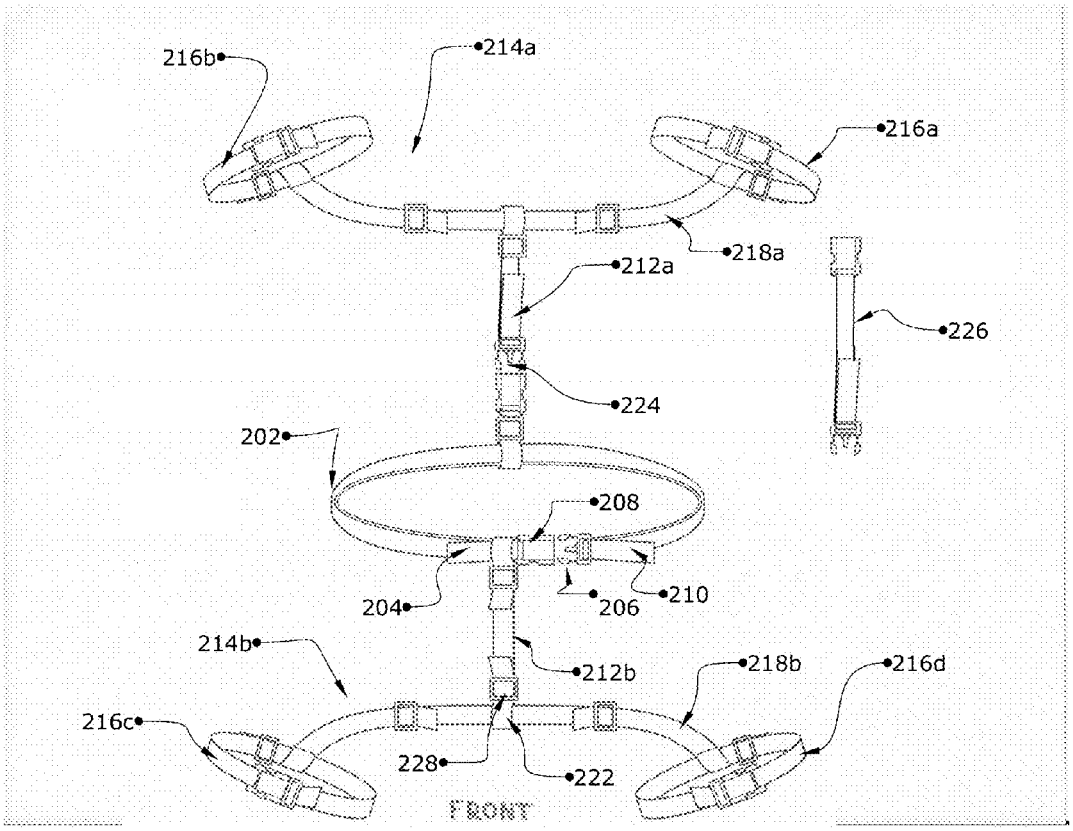
FIG. 2 illustrates a plan view of an exemplary embodiment of a portable seat restraint apparatus.

Referring to FIG. 2, a plan view of an exemplary embodiment of a portable seat restraint apparatus is illustrated, showing common features of various embodiments in addition to many optional features. As shown, the restraint includes a waist strap 202 that may comprise an elongated strap with ends (204 and 210) being connectable around the waist of a child (not shown). An exemplary waist strap may comprise one or more straps having a length of from, for example about 50 cm (20 inches) to about 100 cm (40 inches), such that the strap(s) may securely fit about the waist of a child. It will be appreciated that, although the waist strap is shown to have ends 204, 210 in another embodiment, the waist strap may comprise a single strap that may be slid around the waist of an infant or may be tied in a knot.

In one embodiment, waist strap ends 204 and 210 may be placed in communication with a male 206 and female 208 portion of a bayonet clip, respectively. The bayonet clip may also serve to adjust the length of the waist strap such that it can be snugged around the waist of the intended user. Other forms of strap attachments can be employed in place of bayonet clips and include, for example, spring loaded clips, buckles and hook and loop (Velcro™) type of connections. In addition, a method for adjusting the length of the strap and snugging it around the waist of the user may be separate from the connection method. For example, the length adjustment could be a loop, slide, or clasp made of metal or plastic or other rigid material.

As shown, the portable seat restraint may comprise support straps 216*a-d*, connecting straps 212*a,b*, and linking straps 218*a,b*, which may also be connected and have a length adjusted with a variety of methods as described above. Alternatively, if various belts are attached to one another by transversely looping the end of one belt over another 222 and with the length of the looped belt adjusted by a form of buckle 228, the loop and buckle may also serve as a mechanism to attach and detach one strap from another strap. In addition, various embodiments may mix the methods of strap attachment and length adjustment.

Each connecting strap 212*a,b* may connect the waist strap 202 to a support assembly 214*a,b*. In one exemplary embodiment, two connecting straps 212*a,b* may be transversely attached to a waist strap 202 in opposing positions. The connecting straps 212*a,b* may be movably attached to the waist strap 202 such that they can be moved along the circumference of the waist strap 202. In one embodiment, such connection locations can be optimized such that a child may be secured in a position on a seat when wearing the waist strap 202. This generally means the connection locations along the waist strap 202 may be at least a quarter of the circumference of the waist belt apart and more preferably about ⅓, ½, or ⅔ of the circumference apart.

The connecting straps 212*a,b* may be connected to one of more support strap assemblies 214*a,b*. The purpose of a support strap assembly 214*a,b* is to provide an attachment location for the connecting straps 212*a,b* to a structure that is rigidly attached to the seat base on opposing sides of the seat base (not shown in FIG. 2). By adjusting the length of the connecting straps 212*a,b*, the waist strap 202 when snugged around the waist of a child, can be configured such that the child has a certain freedom of movement, but cannot fall off the seat. In the pictured embodiment, each support strap assembly 214*a,b* comprises a linking strap 218*a,b* connected on each end to a support strap 216*a,b,c,d*. As shown, each support strap assembly (e.g., 214*a*) comprises a single linking strap (e.g., 218*a*) connecting two support straps (e.g., 216*a,b*) designed to encircle two support structures (e.g., chair legs). Accordingly, an exemplary restraint apparatus may comprise a single waist strap 202 connected to two connecting straps 212*a,b*, which are each connected to a support assembly 214*a,b* comprising a linking strap 218*a,b* and connecting two support straps 216*a,b,c,d*.

In one embodiment, the method of attachment between the waist strap 202 and the connecting straps 212*a,b*, and the connecting straps and the support strap assembly 214*a,b*, can be either fixed (e.g., stitched together) or a removable loop connection (e.g., 222). The advantage of a loop connection or other form of removable connection is that it allows the connection location to be adjusted and/or allows the use of different subassemblies that may function more efficiently for different types of seats. Various seat designs may lend themselves to a different configuration where a support strap 216*a, b,c,d* is connected directly to a connecting strap 212*a,b*. In other words, a linking strap 218*a* could be removed from the support strap assembly 214*a* and one or more support straps 216*a,b* could be attached directly to the connecting strap 212*a*.

As shown in FIG. 2, a connecting strap may comprise a detachable connection 224 along its length. This detachable connection 224 may allow an extension strap 226 to be employed to extend the connecting strap 212*a* for certain applications. A detachable connection strap 224 could be deployed, for example, when there is a seat back attached directly to a seat base, and a connecting strap needs to traverse over the seat back and down the back of the seat back in order to be secured to a support structure. Alternatively in an embodiment with a detachable connection 224 in both connecting straps 212*a,b*, the extension strap 226 could act as the support strap assembly 214*a,b* by simply connecting the portion of each connecting strap 212*a,b* that is attached to the waist strap 202 to opposing ends of the extension strap 226 when the extension strap is looped underneath the seat base.

In embodiments that utilize a form of quick connection, for example, bayonet clips, the apparatus may be readily installed or uninstalled and fitted or removed from the user. The apparatus, when not in use, can be stored preconfigured for a particular application by leaving the waist strap 202 connected to connecting straps 212*a,b*, which in turn may be connected to support strap assemblies 214*a,b*. Storage for the apparatus may consist, for example, of a mesh bag or a built-in pouch, for example, a diaper bag. To deploy the apparatus for an embodiment similar to that depicted in FIG. 2, the apparatus may be spread out over the chair seat with the connecting straps 212*a,b* draped over the front and rear edge of the seat base. Support straps 216*a,b,c,d* are then buckled around support structures such as chair legs underneath the seat. The user of the apparatus is then placed on the seat with the front support strap 212*b* placed between the legs of the user and the back support strap 212*a* placed at an opposing position behind the user. In one embodiment, removal of the apparatus happens in the reverse order.

Figure 3:
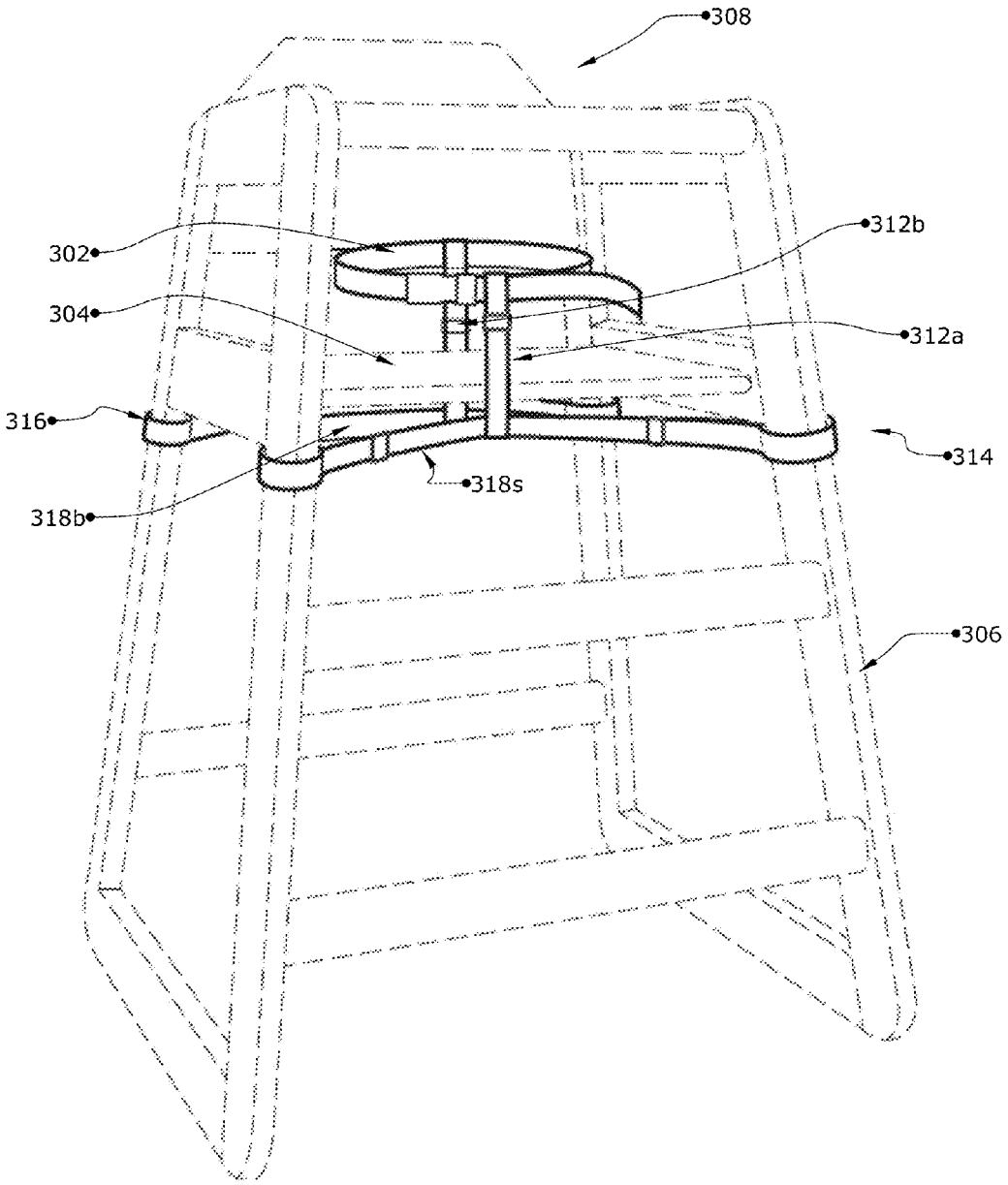
FIG. 3 illustrates an exemplary embodiment of a portable seat restraint apparatus attached to four legs of a highchair with additional linking straps 318.

Referring to FIG. 3, an exemplary embodiment of the portable seat restraint apparatus is illustrated in use with a highchair 308. As shown, the apparatus comprises a support strap assembly 314 comprising four support straps 316 adapted to be secured around each chair leg 306. The support strap assembly 314 is further shown to comprise a front linking strap 318*a* transversely connected to a front connecting strap 312*a* and a back linking strap 318*b* transversely connected to a back connecting strap 312*b*, the linking straps connected on each end to a support strap 316. Detail of length adjustments and connectors for the various straps are not shown, but the possible methods for adjustments and connection described previously apply here as well.

Figure 4A:
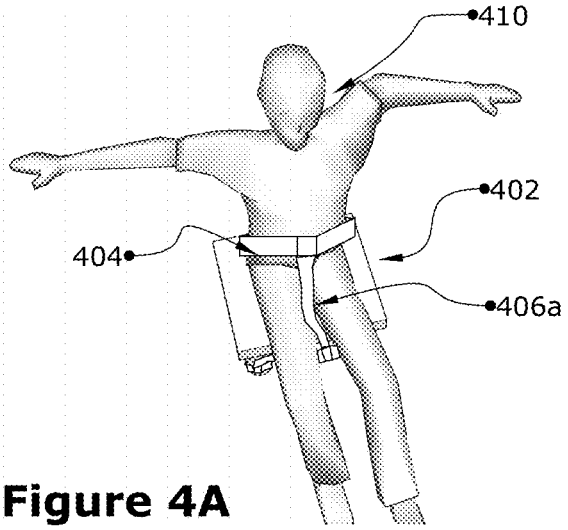
FIGS. 4A and B illustrate perspective views of a portable seat restraint in place about the waist of a seated user.
Figure 4B:
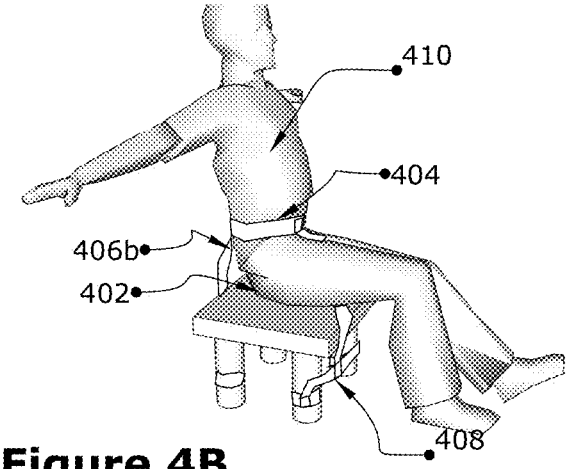

Referring to FIGS. 4A and 4B, an exemplary method of securing an individual to a seat using a portable restraint apparatus according to the invention is illustrated. As shown, a waist strap 404 is transversely attached to two connecting straps 406*a,b* on opposing sides of the circumference of the waist strap 404. A front connecting strap 406*a* travels between the legs of the user of the seat restraint. It should be noted that in other embodiments, a front connecting strap 406*a* does not necessarily need to be between the legs of the user provided connecting straps are opposed sufficiently with respect to the circumference of the waist belt to enable them to be tensioned one against the other in order to prohibit the user 410 from coming off the seat 402. This would necessitate the user 410 be restricted in motion such that they could not rise more than about 5 cm (2 inches) off the seat base. In some embodiments, it may be desirable to have connecting straps 406*a,b* rigidly attached to support straps 408 rather than slidably attached. This may reduce the need for cinching and provide more freedom of movement for the user.

Figure 5:
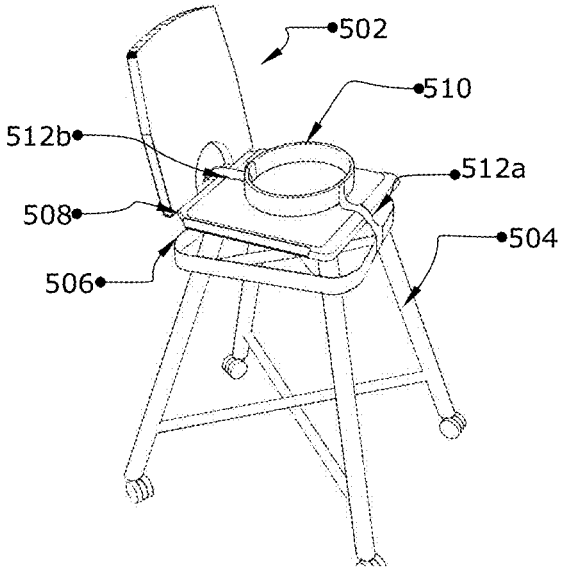
FIG. 5 shows a partial embodiment of a portable seat restraint apparatus in perspective view shown with a single support strap 506.

Referring to FIG. 5, a highchair 502 with four legs 504 with a waist strap 510 attached to two connecting straps 512*a,b* is illustrated. As shown, the connecting straps 512*a,b* may be attached to a single support strap assembly 506 comprising a single strap that is length adjustable to fit around all of the chair legs 504 and remain in place underneath a protruding seat base 508. In the embodiment illustrated in FIG. 5 single support strap assembly 506 when installed and tensioned around all the chair legs 504, effectively keeps the connecting straps 512*a,b* from sliding past a chair leg 504 and keeps connecting straps 512*a,b* in opposing locations.

Figure 6:
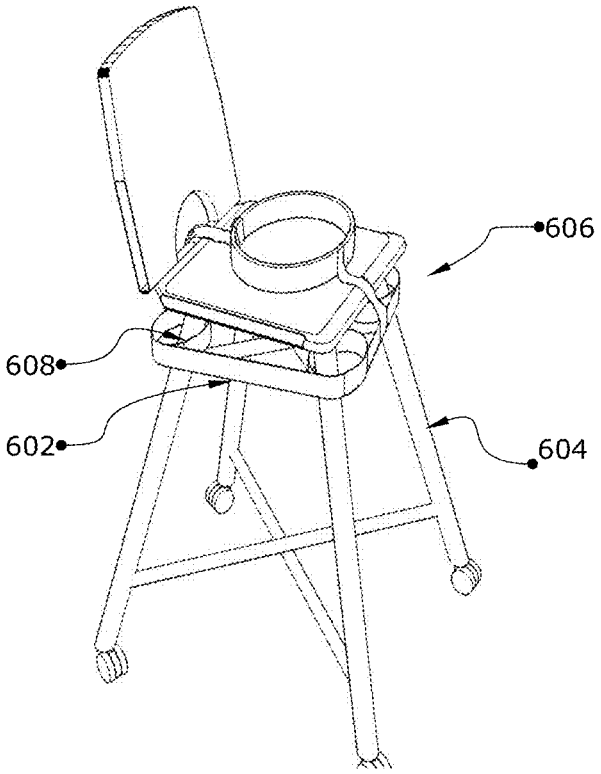
FIG. 6 shows a partial embodiment of a seat restraint apparatus in perspective view shown with a single linking strap 602 and multiple support straps 604.

FIG. 6 illustrates another embodiment where the support strap assembly 606 comprises a single linking strap 602 designed to go around the outside of the support structure (in this case four legs 604) with four movably attached support straps 604. Notice in this embodiment that the support straps 608 are shown as being attached to the linking strap 602 in a parallel (rather than transverse) method. This attachment method would further entail attachment using a buckle or loop (not shown) such that the linking strap 602 is slidably attached to support straps 608. This configuration allows the support straps 608 to move relative to one another such that they can be attached to different support structures (for example chair legs 604) on different seats while removing any slack in the linking strap 602 between the support structures.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A method of securing a child in a highchair comprising a seat, two front legs, and two back legs, the method comprising:

securing a front support assembly to the highchair, wherein the front support assembly comprises two front support straps connected to a front linking strap, and a front connecting strap attached to the front linking strap, and wherein securing the front support assembly to the highchair comprises securing the front support straps to the two front legs of the highchair;

securing a back support assembly to the highchair, wherein the back support assembly comprises two back support straps connected to a back linking strap, and a back connecting strap attached to the back linking strap, and wherein securing the back support assembly to the highchair comprises securing the back support straps to the two back legs of the highchair; and securing the waist strap around a waist of the child, wherein the front connecting strap and back connecting strap are connected to the waist strap.

2. The method of claim 1, wherein the front connecting strap is located between legs of the child.

3. The method of claim 1, wherein securing the waist strap around the waist of the child further comprises adjusting the length of the waist strap such that it fits snuggly around the waist.

4. The method of claim 1, wherein securing the front support straps to the two front legs of the highchair comprises looping each of the front support straps around a front leg and attaching a first end of the front support strap to a second end of the support strap with a fastener.

5. The method of claim 1, wherein securing the back support straps to the two back legs of the highchair comprises looping each of the back support straps around a back leg and attaching a first end of the back support strap to a second end of the back support strap with a fastener.

6. The method of claim 1, further comprising attaching the front connecting strap to the waist strap.

7. The method of claim 1, further comprising attaching the back connecting strap to the waist strap.

* * * * *